United States Patent [19]

Williams

[11] 3,930,340

[45] Jan. 6, 1976

[54] SHOT CONTROL VALVES

[76] Inventor: Alsan Williams, 37 Briarlands Avenue, Sale, Cheshire, England

[22] Filed: Aug. 12, 1974

[21] Appl. No.: 496,382

[30] Foreign Application Priority Data

Dec. 14, 1973 United Kingdom ..... 58140/73

[52] U.S. Cl. ..... 51/12

[51] Int. Cl.[2] ..... B24C 7/00

[58] Field of Search ..... 51/12, 8 R, 319–321; 72/53

[56] References Cited

UNITED STATES PATENTS

| | | | |
|---|---|---|---|
| 1,443,762 | 1/1923 | Smith | 51/12 |
| 2,365,948 | 12/1944 | Gossard | 51/12 |
| 3,521,407 | 7/1970 | Nalley | 51/12 |
| 3,629,976 | 12/1971 | Carpenter | 51/12 |
| 3,675,374 | 7/1972 | Wilder | 51/12 |

FOREIGN PATENTS OR APPLICATIONS

| | | | |
|---|---|---|---|
| 333,467 | 2/1921 | Germany | |
| 326,947 | 6/1935 | Italy | 51/12 |

*Primary Examiner*—Donald G. Kelly

*Attorney, Agent, or Firm*—McDougall, Hersh & Scott

[57] ABSTRACT

A valve member for abrasive blasting machine in which the valve member is formed of a valve plate of magnetic material sandwiched between plates of larger dimension than the magnetic plate but of lesser dimension that the passage through which the abrasive material passes from the supply source to the blasting wheel whereby the annular space between the valve member and the inner walls of the passage becomes filled with abrasive material attracted to the valve member in closed position to close the passage.

5 Claims, 4 Drawing Figures

SHOT CONTROL VALVES

This invention relates to valves for controlling the flow of abrasive in shot blasting equipment.

In the shot blasting industry, abrasive material, usually magnetizable metal shot, flows from a hopper along a delivery tube, onto blades of a rotating throwing wheel, which impels the abrasive particles against the article to be cleaned. The flow of abrasive material to the throwing wheel is controlled by a valve associated with the delivery tube. The valve is enclosed within the tube. Such a valve consists of a plate which can be swung to closed position across the delivery tube outlet to effect closure of the same, or to open position to one side of the delivery tube to permit flow of the abrasive material to the throwing wheel. Such valves allow the escape of considerable noise from the throwing wheel of such intensity as to be detrimental to the hearing of the operator and it is an object of this invention to provide an improved control valve which reduces this hazard.

These and other objects and advantages of this invention will hereinafter appear and for purposes of illustration, but not of limitation, an embodiment of the invention is shown in the accompanying drawing, in which -

Figure 2:
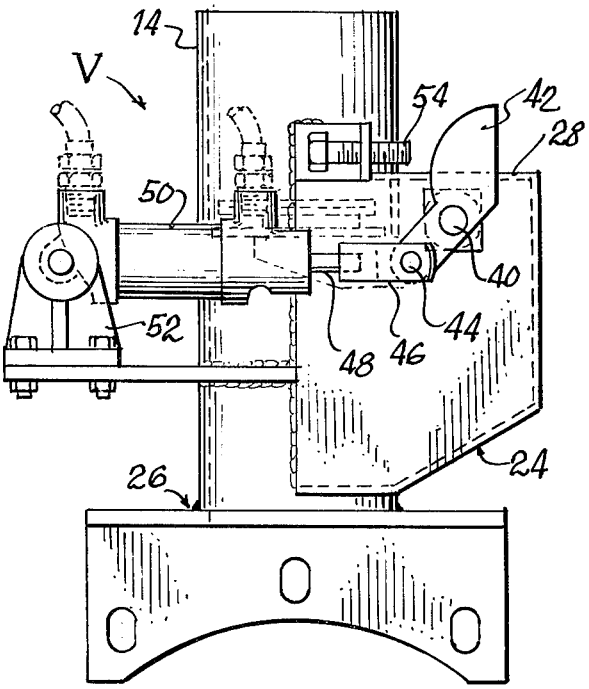
FIG. 2 is a front elevational view of the valve member shown in FIG. 1.
Figure 3:
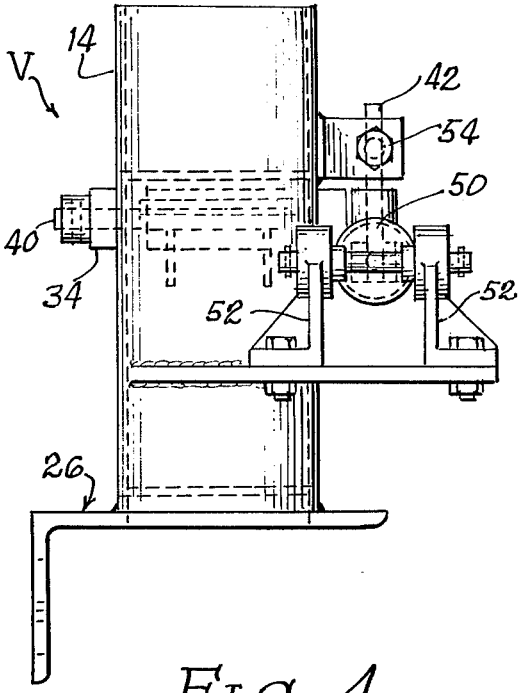
FIG. 3 is an end elevational view of the valve member shown in FIG. 1.
Figure 4:
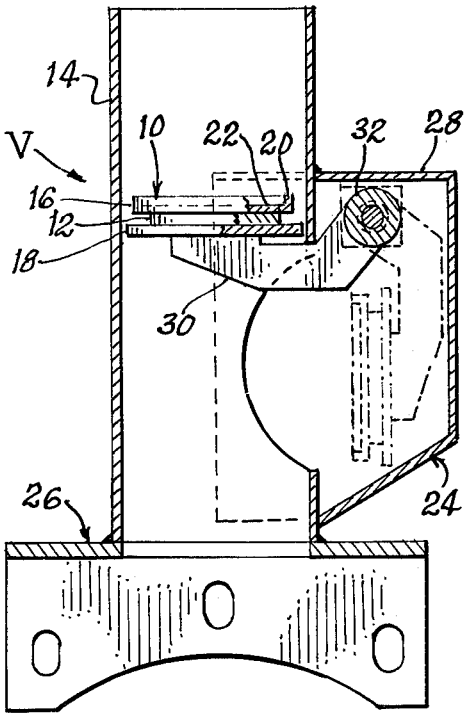
FIG. 4 is a sectional view taken along the line 4—4 of FIG. 1.
Figure 1:
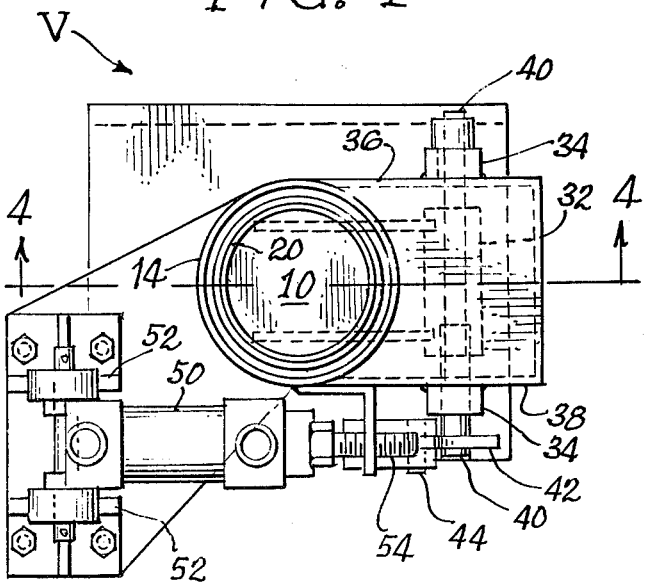
FIG. 1 is a top plan view of the valve member embodying the features of this invention.

According to an aspect of the present invention, there is provided a valve for use in controlling the flow of magnetizable abrasive from a supply to a throwing wheel via a delivery tube, in which the valve is wholly enclosed in a housing communicatingly connecting the delivery tube and a shrowd of a throwing wheel.

According to another aspect of the present invention, there is provided a valve for use in controlling the flow of magnetizable abrasive from a supply to a throwing wheel, via a delivery tube, in which the control valve comprises a magnetic or magnetizable valve member mounted for pivotal movement between a closed position across the delivery tube interior to an open position alongside the delivery tube, but in which the valve member is of lesser cross-sectional area than that of the interior of the delivery tube so as to provide an open space in between, but which magnetically attracts a collar of the magnetizable abrasive, when in closed position, to cause buildup in a manner to effect complete closure of the delivery tube in combination with the valve member.

The valve member is preferably wholly enclosed as aforesaid.

The top surface of the valve member is preferably formed with a lip so that a layer of abrasive is created across the surface thereby to assist in resisting valve wear.

More specifically, the valve member comprises a magnetic plate sandwiched between two larger plates, of similar cross-sectional shape as that of the delivery tube, with the bottom plate being larger in area than the top plate and having a slightly smaller cross-sectional area than the delivery tube so that the collar of abrasive which is formed in the gap between the periphery of the valve member and the tube wall will be of substantially conical shape.

Means are preferably provided for pivoting the valve member between horizontal (valve closed) position and vertical (valve open) position.

The invention will now be described by way of example, reference being made to the accompanying drawings.

The control valve V consists of a valve member 10 formed of a circular flat disc plate 12 of magnetic or magnetizable material, preferably formed of a ceramic, which is either a permanent magnet or an electromagnet, having a diameter which is less than the internal diameter of the delivery tube 14 which is disposed between a supply hopper (not shown) and a throwing wheel (not shown), through which the abrasive material travels from the supply hopper to the throwing wheel.

The magnetic plate 12 is sandwiched between two circular metal plates 16 and 18 in which the metal plate 16 facing in the upstream direction is formed of an abrasive resistant material, preferably with a lip portion 20 about its periphery on the face of the plate opposite the magnetic plate 12, to form a recess 22. The other plate 18, on the opposite side of the magnetic plate 12, can be formed of a mild seal. Both the circular plates 16 and 18 are of larger diameter than the magnetic plate 12, but of lesser diameter than the interior diameter of the delivery tube 14 to provide an annular space therebetween.

The valve member is enclosed within a housing 24 joined to the end of the delivery tube 14 and which opens into a shrowd 26 enclosing the throwing wheel. The housing has a portion 28 which extends laterally of the delivery tube 14, for housing the means by which the valve member is pivoted between closing position across the open end of the delivery tube, and open position out of the path of the delivery tube.

For this purpose, a pair of arms 30 are fixed at one end to the backside of the plate 18, while the other ends of the arms 30 are fixed to a shaft 32 mounted for rotational movement within a sleeve 34 fixed to the opposite outer side walls 36 and 38 of the housing, about openings therethrough, with end portions 40 of the shaft extending through the openings, and sleeve for a distance beyond the outer side walls of the housing.

Means are provided for rocking the shaft to pivot the valve member between open and closed position.

In the illustrated modification, such means comprises a bell lever 42 which is mounted intermediate its ends onto a through-extending portion 40 of the shaft 32 as the pivot. A portion of the bell lever 42 offset from the pivot is pivotally connected at 44 onto a bracket 46 fixed onto the end of a rod 48 mounted for rectilinear movement in an air cylinder 50. The air cylinder 50 is mounted at its base onto a bracket 52 fixed to a frame section. The rectilinear movement of the piston and cylinder assembly is out of line with the pivot so that the lever arm will be rocked about its pivot responsive to movement of the rod into and out of the air cylinder.

The extent of movement is calculated to the amount required to rock the valve member between closed position across the delivery tube and open position in which the valve member is disposed to extend vertically within the extension portion of the housing, completely out of the path of the delivery tube. There is an adjustable stop 54 for controlling the degree of pivotal movement of the valve.

When the valve is in closed position, the top and bottom plates 16 and 18 of the valve member define, with the tube, a tapered annular gap which becomes filled with abrasive material magnetically attracted by the magnetic disc 12 of the valve member. Abrasive material is also magnetically attracted to the top surface of the plate 16 to provide a layer of abrasive material onto the surface thereof. The abrasive lies on top of the valve member, within the lip when the valve member is in the closed or partially open positions.

The fact that the valve member is wholly enclosed within the housing operates substantially to reduce the noise level to an acceptable degree.

The valve member of this invention is easier to open and close since the valve periphery does not make a tight fit with the delivery tube but instead relies upon the buildup of abrasive material in the intervening conical space to complete closure of the delivery tube when the valve is operated to closed position.

It will be understood that changes may be made in the details of materials, construction, arrangement and operation, without departing from the spirit of the invention, especially as defined in the following claims. I claim:

1. In an abrasive blasting machine in which a magnetically attractable abrasive material is fed from a supply to a blasting member through a feed passage, a valve member mounted in cooperation with the feed passage for movement between closed position across the feed passage and open position out of the path of the feed passage, said valve member comprising a plate formed of magnetized material having a cross-section generally corresponding to the cross-section of the feed passage but having a cross-sectional area less than that of the feed passage to provide a spaced relation about the valve member when in closed position, but which becomes filled to close the passage by abrasive material which is attracted to the valve plate to close the passage, and means for movement of the valve member between open and closed positions.

2. A machine as claimed in claim 1 in which the plate of magnetic material is sandwiched between a pair of disc plates each of which is larger in cross-sectional area than the magnetized plate but less than the inner cross-sectional area of the passage, with the disc plate in the upstream direction being smaller in cross-sectional area than the disc plate on the opposite side of the magnetic plate whereby the space about the valve member is substantially of conical shape when in closed position.

3. A machine as claimed in claim 2 in which the disc plate facing in the upstream direction is formed with a lip portion about the periphery which extends in the upstream direction to define a recess in the body portion of the plate which becomes covered with abrasive material.

4. A machine as claimed in claim 1 which includes an enclosure that extends to one side of the passage and in which the valve member is mounted for rocking movement between closed position, in the path of the passage, and open position to one side of the passage.

5. A machine as claimed in claim 4 in which the valve member extends horizontally into the path of the passage in closed position and vertically to one side of the passage in open position.

* * * * *